US010085579B2

(12) United States Patent
Milligan

(10) Patent No.: US 10,085,579 B2
(45) Date of Patent: Oct. 2, 2018

(54) AID FOR DONNING A SOCK

(71) Applicant: Michael John Milligan, Marlborough Sounds (NZ)

(72) Inventor: Michael John Milligan, Marlborough Sounds (NZ)

( * ) Notice: Subject to any disclaimer, the term of this patent is extended or adjusted under 35 U.S.C. 154(b) by 0 days.

(21) Appl. No.: 15/127,006

(22) PCT Filed: Mar. 18, 2015

(86) PCT No.: PCT/NZ2015/000016
§ 371 (c)(1),
(2) Date: Sep. 16, 2016

(87) PCT Pub. No.: WO2015/142188
PCT Pub. Date: Sep. 24, 2015

(65) Prior Publication Data

US 2017/0105562 A1 Apr. 20, 2017

(30) Foreign Application Priority Data

Mar. 19, 2014 (NZ) ..... 622677

(51) Int. Cl.
*A47G 25/90* (2006.01)

(52) U.S. Cl.
CPC ..... *A47G 25/905* (2013.01); *A47G 25/90* (2013.01)

(58) Field of Classification Search
CPC ..... A46G 25/90; A46G 25/905; A46G 25/907
See application file for complete search history.

(56) References Cited

U.S. PATENT DOCUMENTS 2,894,669 A * 7/1959 Silken ..... A47G 25/905 223/111
5,303,856 A * 4/1994 Weatherholt, Sr. ..... A47G 25/905 223/111
5,626,269 A * 5/1997 Duarte ..... A47G 25/905 223/112
5,630,534 A * 5/1997 Maier ..... A47G 25/905 223/111
8,356,735 B1 * 1/2013 Drakeford ..... A47G 25/908 223/112
8,528,796 B1 * 9/2013 Bosko ..... A47G 25/905 223/111
8,657,165 B1 * 2/2014 Liu ..... A47G 25/905 223/111
2007/0095866 A1 * 5/2007 Zumbach ..... A47G 25/905 223/111

(Continued)

*Primary Examiner* — Ismael Izaguirre
(74) *Attorney, Agent, or Firm* — Lowry Blixseth LLP; Scott M. Lowry

(57) ABSTRACT

As shown in figure (1), an aid for donning a sock has a base (1), a handle (2) joined to and extending upwards from the base, a pair of spreaders (7), and moving means adapted to move the spreaders (7) up and down when desired. The arrangement is such that a human is able to operate the moving means to cause the spreaders (7) to move upwards so as to be accessible from a standing position. From there the user can load a sock to one of the spreaders so that it holds the sock open. The user then operates the moving means to cause the spreader and sock to move downwards to at or adjacent to ground level. Gripping the handle (2, 5) to receive significant stability while standing on one foot, the user is then able to maneuver at least part of their other foot into the sock.

9 Claims, 2 Drawing Sheets

(56) References Cited

U.S. PATENT DOCUMENTS

2008/0110945 A1* 5/2008 Cookman ..... A47G 25/905
223/111

* cited by examiner

AID FOR DONNING A SOCK

FIELD OF THE INVENTION

This invention relates to an aid for donning a sock.

BACKGROUND

Some people, for example the aged or infirm, have limited flexibility and as a result find it difficult to bend over and put on socks. It is an object of the present invention to go at least some way towards addressing this problem or to at least provide the public with a useful choice.

SUMMARY OF INVENTION

According to one aspect of the invention there is provided an aid for donning a sock, comprising:

a base;

a handle joined to and extending upwards from the base;

at least one spreader;

moving means (eg a crank handle mechanism) adapted to move the spreader up and down when desired;

the aid formed such that when it is in use a human is able to:

operate the moving means to cause the spreader to move upwards so as to be accessible from a standing position;

load a sock to the spreader so that the spreader holds the sock open;

operate the moving means to cause the spreader and sock to move downwards to at or adjacent to ground level;

grip the handle to receive significant stability while standing on one foot; and maneuver at least part of the person's other foot into the sock while it is held open by the spreader.

Optionally the handle is length adjustable.

Optionally the spreader comprises a generally concave sock receiving portion.

Optionally the aid has a second spreader spaced from, but otherwise arranged substantially the same as, the first mentioned spreader.

Optionally the handle is arranged such that when the aid is in its normal in use disposition the handle is at an angle of 70°-90° degrees with respect to the base.

Optionally the handle is generally T shaped.

Optionally the aid comprises a crank mechanism which incorporates cable to move the spreader(s) up and down depending on which direction a winder of the mechanism is turned.

Optionally the cable is housed by, and moves within, the handle.

DRAWINGS

Some preferred embodiments of the invention will now be described by way of example and with reference to the accompanying drawings, of which:

DETAILED DESCRIPTION

Figure 1:
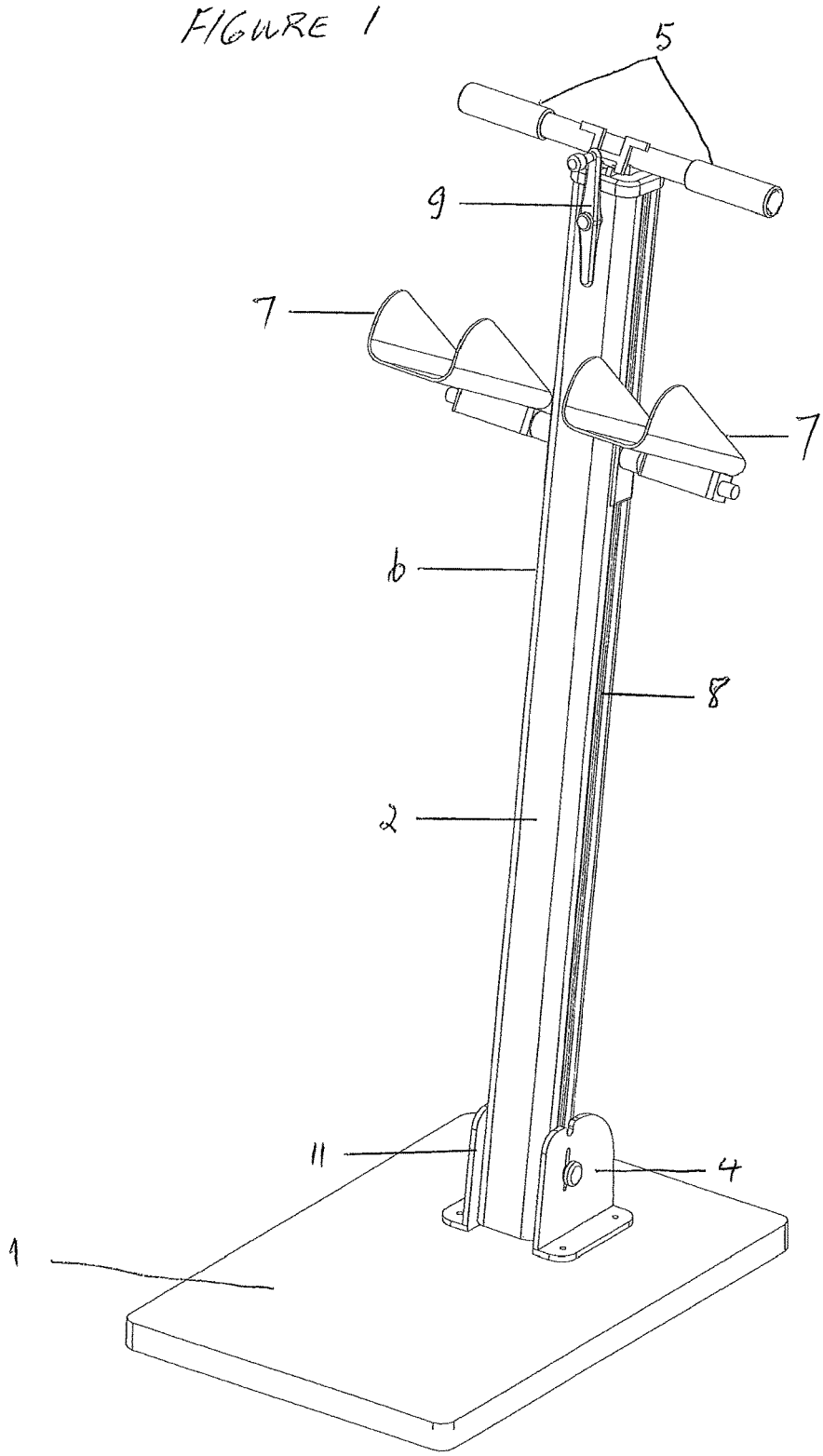
FIG. 1 is an isometric view of a sock donning aid.
Figure 2:
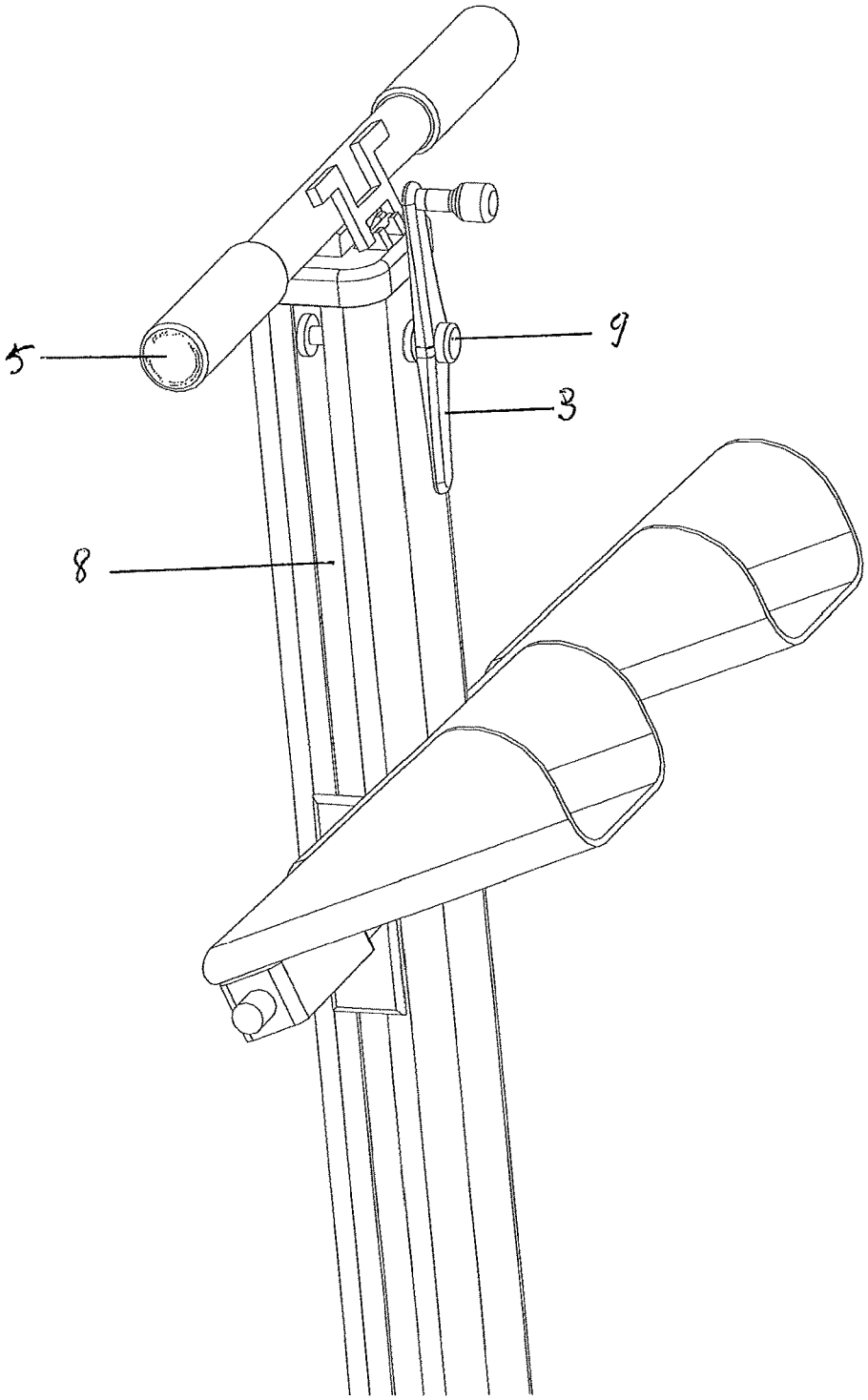
FIG. 2 is an isometric view showing detail of an upper part of the aid.

As shown, the sock donning aid has a plate like base 1, a generally T-shaped handle 2 secured to the base and extending upwards at an angle, and a crank mechanism 3. The handle 2 may be unlocked from its normal upright in-use disposition and swung about a pivot mechanism 4 to lay flat against the base 1 for convenient storage and transportation. The handle has two handgrips 5 disposed each side of a central shaft 6. The crank mechanism 3 is operatively connected to a pair of generally concave spreaders 7 by wires (not shown) operatively arranged within the shaft 6. The spreaders 7 are disposed to the left and right of the handle 2 respectively and slide up and down along linear openings 8 either side of the handle.

When the sock donning aid is in use a winder 9 of the crank mechanism 3 is rotated by hand to cause the spreaders 7 to move, by way of the wires, to a position near the top of the handle 2 (unless they are there already). More particularly, the winder 9 is rotated about an axis which extends at right angles to the handgrips 5. The opening of a sock (not shown) is then placed around each spreader 7 respectively so as to hold the socks open. The winder 9 is then rotated in reverse until the spreaders 7 and socks are at about ground level, just above the base 1. A human user stands on or immediately next to the base 1 and holds the hand grips 5 to keep balance while maneuvering his or her feet, one after the other, into one or other of the socks. This involves the person standing on one foot while moving his or her slightly raised other foot into the sock, pushing the foot down to cause the sock to end up around the foot, and then repeating this for the other foot and other sock.

In some embodiments of the invention there may be only one spreader 7, but it is preferred that there are two of these. In some embodiments the aid may be readily disassembled by collectively disconnecting the handle 2, crank mechanism 3 and spreaders 7 from a mount 11 of the base 1, and the spreaders 7 may be detached from the handle 2. However this is not essential and in some embodiments the parts, or some of them, may not be detachable.

In some embodiments of the invention the handgrips 5 may be adjustable in terms of length, angle and/or height. They may move through 90° to be set in one or more positions through that angle, and may be able to lay parallel to the main upright part of the handle 2 for ease of storage and transport.

In further embodiments of the invention the base 1 is fitted with wheels (not shown) to facilitate ease of transport, for example from one person or place to another.

While some preferred forms of the invention have been described by way of example it should be appreciated that modifications and improvements can be made without departing from the scope of the following claims.

The invention claimed is:

1. An aid for donning a sock, comprising:

a base;

a handle joined to and extending upwards from the base, the handle comprising gripping portions disposed on each side of a central shaft;

at least one spreader;

moving means adapted to move the spreader up and down when desired, the moving means adapted to be operated at or adjacent an upper portion of the handle to move the spreader both up and down;

the aid formed such that when it is in use a human is able to:

operate the moving means to cause the spreader to move upwards so as to be accessible from a standing position;

load a sock to the spreader so that the spreader holds the sock open;

operate the moving means to cause the spreader and sock to move downwards to at or adjacent to ground level;

grip the handle to receive significant stability while standing on one foot; and maneuver at least part of the person's other foot into the sock while it is held open by the spreader.

2. An aid for donning a sock according to claim 1, wherein the handle is length adjustable.

3. An aid for donning a sock according to claim 1, wherein the spreader comprises a generally concave sock receiving portion.

4. An aid for donning a sock according to claim 1, having a second spreader spaced from, but otherwise arranged substantially the same as, the first mentioned spreader.

5. An aid for donning a sock according to claim 1, wherein the handle is arranged such that when the aid is in its normal in use disposition the handle is at an angle of 70°-90° degrees with respect to the base.

6. An aid for donning a sock according to claim 1, wherein the handle is generally T shaped.

7. An aid for donning a sock according to claim 1, having a crank mechanism which incorporates cable to move the spreader(s) up and down depending on which direction a winder of the mechanism is turned.

8. An aid for donning a sock according to claim 7, wherein the cable is housed by, and moves within, the handle.

9. An aid for donning a sock, comprising:

a base;

a handle joined to and extending upwards from the base at an angle of 70°-90°, the handle comprising gripping portions disposed on each side of a central shaft;

a pair of concave spreaders disposed either side of the handle;

a crank handle mechanism adapted to move the spreader up and down when desired by way of cable, the crank handle adapted to be operated at or adjacent an upper portion of the handle to move the spreader both up and down;

the aid formed such that when it is in use a human is able to:

operate the crank handle to cause one or both of the spreaders to move upwards so as to be accessible from a standing position;

load a sock to one of the spreaders so that such spreader holds the sock open;

operate the crank handle to cause the spreader with the sock to move downwards to at or adjacent to ground level;

grip the handle to receive significant stability while standing on one foot; and maneuver at least part of the person's other foot into the sock while it is held open by the spreader having that sock.

* * * * *